United States Patent [19]

Elward

[11] 4,362,240

[45] Dec. 7, 1982

[54] ARTICLE CARRIER CARTON

[75] Inventor: John R. Elward, Novato, Calif.

[73] Assignee: Pacific Paperboard Products, Inc., San Mateo, Calif.

[21] Appl. No.: 243,726

[22] Filed: Mar. 16, 1981

[51] Int. Cl.[3] ..... B65D 75/00

[52] U.S. Cl. ..... 206/188; 206/176; 206/193; 206/196; 229/28 BC; 229/52 BC; 229/15

[58] Field of Search ..... 229/28 BC, 52 BC, 15; 206/188, 162, 175, 176, 193, 196

[56] References Cited

U.S. PATENT DOCUMENTS

| | | | |
|---|---|---|---|
| 3,400,856 | 9/1968 | Arneson | 206/188 |
| 3,554,401 | 1/1971 | Wood | 206/188 |
| 3,568,880 | 3/1971 | Harrelson | 206/188 |
| 3,857,483 | 12/1974 | Wood | 206/188 |
| 4,144,966 | 3/1979 | Kulig | 206/188 |
| 4,308,950 | 1/1982 | Wood | 206/188 |

*Primary Examiner*—Joseph Man-Fu Moy

[57] ABSTRACT

A basket type multi-use carrier carton of the top-opening type having double thicknesses of material between each adjacent carried article. The carton is made from a cartonboard blank which minimizes the number of folds and the amount of blank material required by auxillary overlying separator strips adhered to the internal separator panels located in one area of the blank that separate some of the carried articles.

3 Claims, 12 Drawing Figures

ARTICLE CARRIER CARTON

BACKGROUND OF THE INVENTION

The invention is an improvement over the article carrier disclosed in U.S. Pat. No. 3,349,957 issued to Prentice J. Wood on Oct. 31, 1967 which broadly discloses a similar kind of carrier carton and employs separate strips of material adhered to the carton blank.

SUMMARY OF THE INVENTION

This invention relates generally to basket type multi-use article carrier cartons and more particularly to a top-opening bottle carton having double, full-height thicknesses of cartonboard or other material between each adjacent bottle.

A principal object of the invention is to provide a carrier carton efficiently formed from a single die-cut and folded blank of cartonboard which minimizes the amount of cartonboard required for article, particularly glass bottle, separation.

Another object is to provide a carrier carton blank design which utilizes separate strips of material adhered to selected locations in one general area on the blank so as to provide the double thickness required for article separation and thereby minimize the amount of folding and the amount of cartonboard required for the blank.

Still another object of the invention is to provide a carrier carton made from thin cartonboard stock which provides double thickness of material between carried bottles in order to meet shipping requirements.

One further object is a carrier carton that is assembled to a completed, collapsed condition for convenience of shipping and storage and then is easily expanded into its full configuration for loading with the articles to be carried.

Other objects and advantages of this invention will become apparent upon consideration of the following detailed description

BRIEF DESCRIPTION OF THE DRAWINGS

In the drawings forming a part of this application like parts are identified by the same reference numeral.

DESCRIPTION OF THE PREFERRED EMBODIMENT OF THE INVENTION

The carrier carton 1 of this invention is formed from thin, for example 0.020 inch thick, cartonboard stock that is typically used for shipping cartons. The illustrated embodiment is designed for carrying six articles, such as bottles 2, one in each well 3 formed by folding a die-cut and fold-scored blank 4. The carton 1 shown in perspective in FIG. 1 has a medial plane carrying handle designated generally as 5. The carrier carton provides two thicknesses of material between each of the carried bottles.

Figure 3:
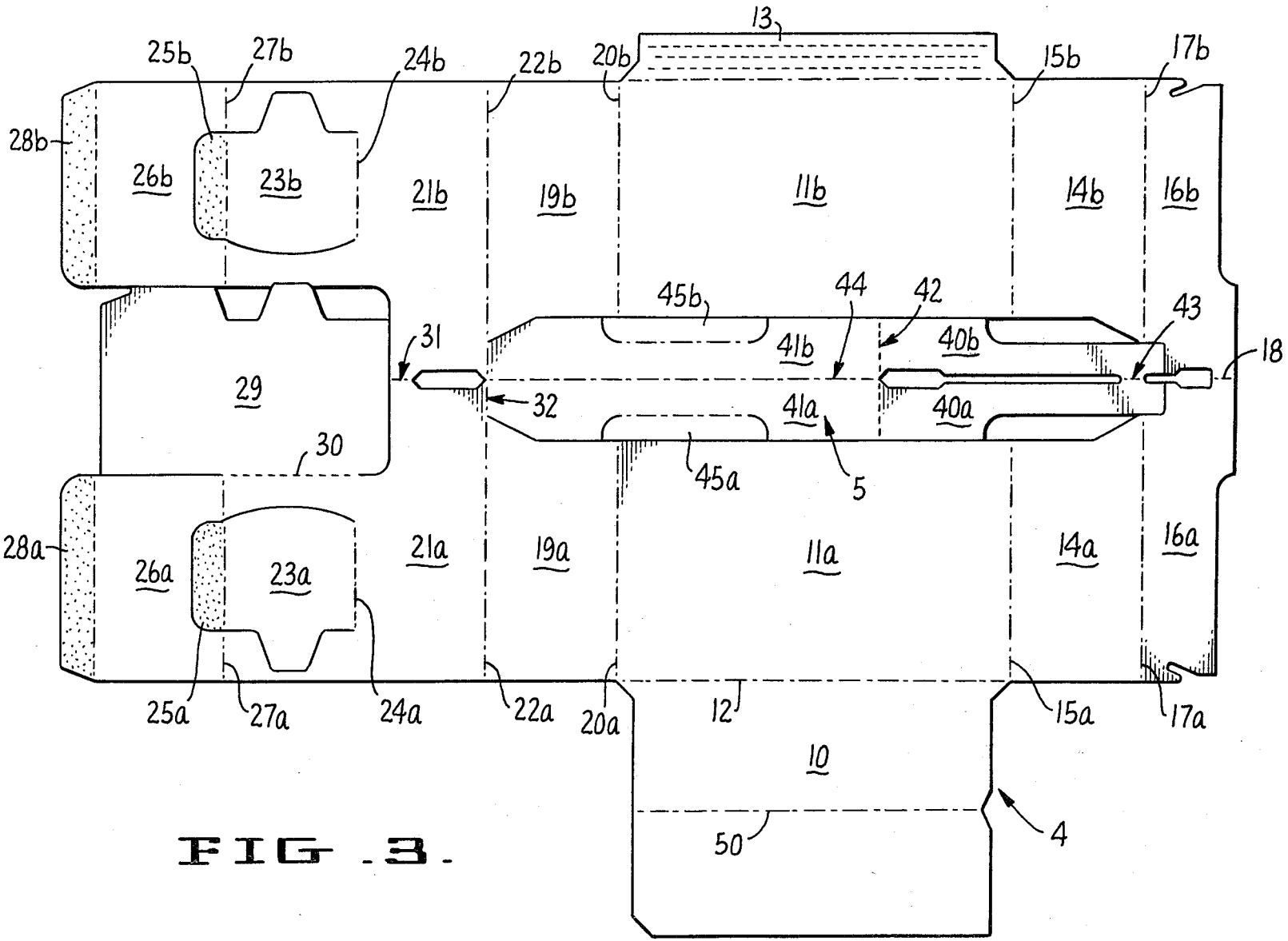
FIG. 3 is a plan view of the cartonboard blank from which the carrier carton is formed.

The blank 4 shown flat in FIG. 3 is cut and scored from cartonboard sheet stock. The blank comprises a bottom panel 10 to which a first sidewall panel **11*a* foldably joins along a bottom-side panel fold line 12. A second sidewall 11*b* carries a foldable tab 13 for securing to it the free margin of the bottom panel 10 which lies opposite the bottom-side panel fold line 12 as is more particularly described in connection with FIGS. 8–12**, in the last two assembly steps for the carton.

A first pair of end-forming panels **14*a*,14*b* each foldably joins to a separate one of the side panels 11*a*,11*b*, respectively, along co-axial fold lines 15*a*,15*b* which are perpendicular to the bottom-side panel fold line 12. A first pair of medial risers 16*a*,16*b* each foldably joins to one of the first pair of end-forming panels 14*a*,14*b*, respectively, along coaxial fold lines 17*a*,17*b* which also are perpendicular to the bottom-side panel fold line 12. This first pair of medial risers 16*a*,16*b* is foldably joined together on the medial axis of the blank and the assembled carrier carton along fold line 18**.

A second pair of end-forming panels **19*a*,19*b* also is foldably joined each to a separate one of the side panels 11*a*,11*b*, respectively, on their sides opposite the first pair of end-forming panels 14*a*,14*b*. They are foldably joined to the side panels along coaxial fold lines 20*a*,20*b* which also are perpendicular to the bottom-side panel fold line 12. A second pair of medial risers 21*a*,21*b* for performing the same function as the first pair are foldably joined along coaxial fold lines 22*a*,22*b* to the end-forming panels 19*a*,19*b***, respectively.

Each of the medial risers **21*a*,21*b* has one internal separator panel 23*a*,23*b*, respectively, struck out near its center. Each of these internal separator panels 23*a*,23*b* is cut on three sides and folds outwardly from the medial riser along co-axial fold lines 24*a*,24*b* respectively. Each has a glue tab 25*a*,25*b*, respectively, which is glued to a corresponding side panel during carton assembly to form a vertical internal separator within the carton as is more particularly shown in FIGS. 1, 2, 5 and 6**.

Medial risers 21*a*,21*b* each carry another internal separator panel 26*a*,26*b*, respectively, at their free ends folded from them along coaxial fold lines 27*a*,27*b* to form another set of internal separator panels when glued to corresponding sidewalls 11*a*,11*b* by means of tabs 28*a*,28*b*. The vertical separation function of internal separator panels 26,26*b* is more clearly illustrated in FIGS. 1, 2, 5 and 6. These internal separation panels define between them the middle article wells 3.

Figure 2:
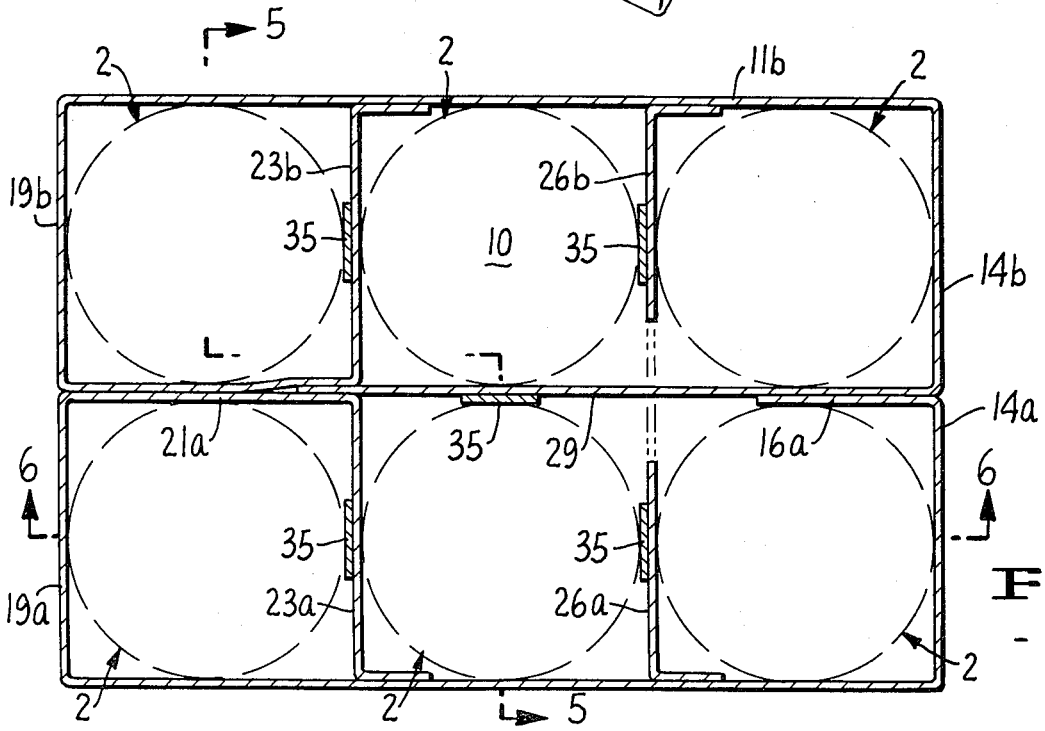
FIG. 2 is a horizontal sectional view through the carton and six carried articles, such as bottles, taken along line 2—2 of FIG. 1.

A medial reinforcing panel 29 is struck out from the blank 4 in the area between medial risers 21*a*,21*b*. This medial reinforcing panel 29 folds along fold line 30 which is generally co-extensive in length with internal separator panel 23*a* and parallel to the bottom-side panel fold line 12. This medial reinforcing panel 29 along with portions of the medial risers 21*a*,21*b* forms the medial separation for the carton. They provide double thickness separation, as can be seen in FIG. 2 between the outermost bottles of the two aligned rows of three and between the middle bottles at top and bottom.

The second pair of medial risers 21*a*,21*b* are joined and fold together along fold line 31 on the carton medial axis in alignment with the fold line 18 for the first pair of medial risers.

Handle 5 is struck out from the center of the carton blank 4 and is foldably joined to medial risers 21*a*,21*b* at fold line 32 which is coaxial with fold lines 22*a*,22*b*. The handle and its method of assembly are more particularly described in connection with FIGS. 7–12 showing assembly of the carton. In general, the handle ultimately is formed of four thicknesses of cartonboard material and is folded from one pair of medial risers and fastens to the other pair of medial risers.

Figure 4:
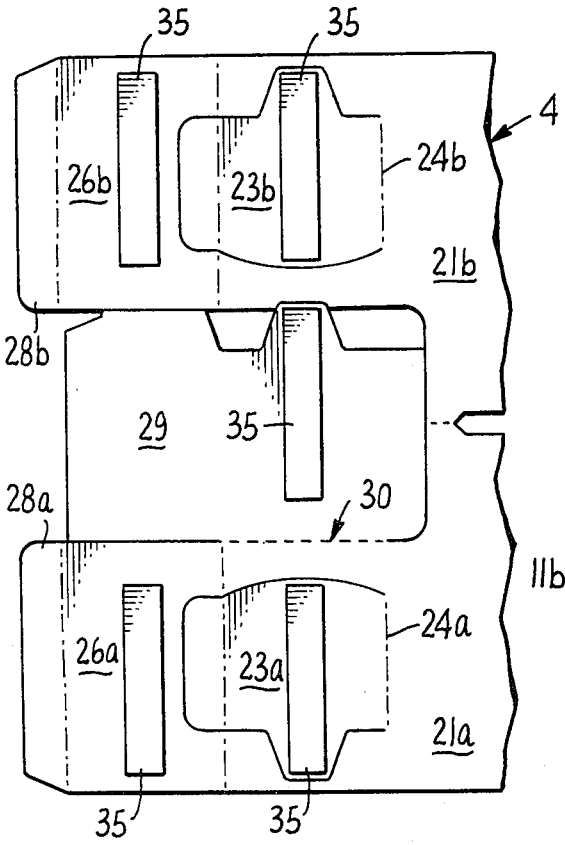
FIG. 4 is a partial plan view of the cartonboard blank of FIG. 3 showing auxillary separator strips adhered to portions of the blank.

A particular feature of the carton construction is the use of separate auxillary separator strips 35 adhered to particular portions of the carton blank in one general area of it as is shown more particularly in FIG. 4. One of each of these similar separator strips 35 is glued to the middle of each of internal separator panels 24*a*,24*b* and 26*a*,26*b*. A fifth separator strip is adhered into medial reinforcing panel 29 in alignment with the strips on separator panel 24*a*,24*b*. As can be seen in the sectional views FIGS. 2, 5 and 6 and in FIG. 1, these separator strips provide double material thickness between the adjacent bottles in the two rows of three and on the medial reinforcing panel between the two middle bottles of the two rows.

These strips preferrably are made of cartonboard stock equivalent to that of the relatively thin 0.020 inch cartonboard from which the entire carton is made. The strips for example, also may be 0.020 inch thick cartonboard material. With the panels upon which they mount, both form a double thickness of material between the carried articles or bottles to meet interstate shipping requirements of Rule 41 and prevent breakage of the bottles during transportation. The strips may also be made of material other than cartonboard stock. They may also be of material less thick than that described. However, the combined thickness of the strips and cartonboard stock should total at least 0.040 inches to meet Rule 41 shipping requirements for separation. The carton material could be 0.018 inch thick and the auxillary separator strips 0.022 inch thick, for example.

Figure 7:
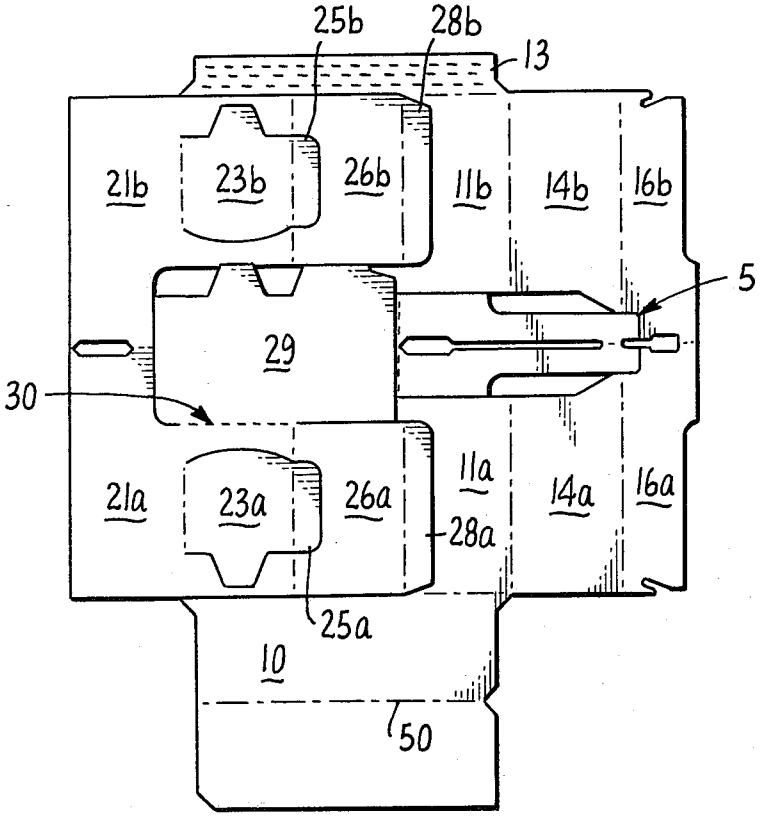
FIG. 7 is a plan view of the blank showing a first fold and glue step for forming internal separator panels during carton assembly.

FIGS. 7–12 illustrate the carton assembly steps after the separator strips 35 have been adhered to the blank 4 as shown in FIG. 4. Assembly of the carton carrier is accomplished by first applying glue to the tabs 25*a*,25*b* and 28*a*,28*b* shown by stippling in FIG. 3. The carton blank is then folded along coaxial fold lines 22*a*,22*b* to adhere the glue carrying tabs to their respective sidewalls 11*a* and 11*b* of the carton as shown in FIG. 7.

Figure 8:
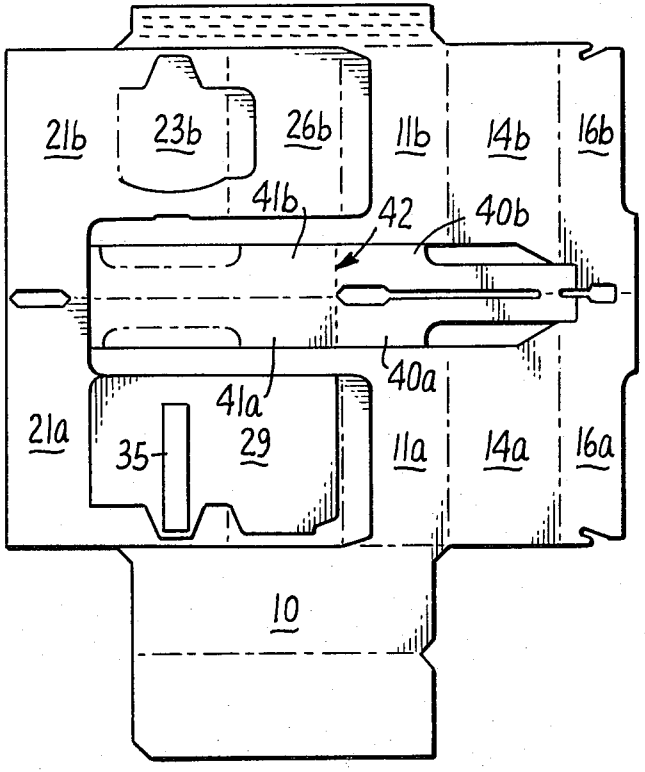
FIG. 8 is a plan view of the partially folded blank of FIG. 7 showing a second folding step for the medial reinforcing panel of the carrier carton.
Figure 9:
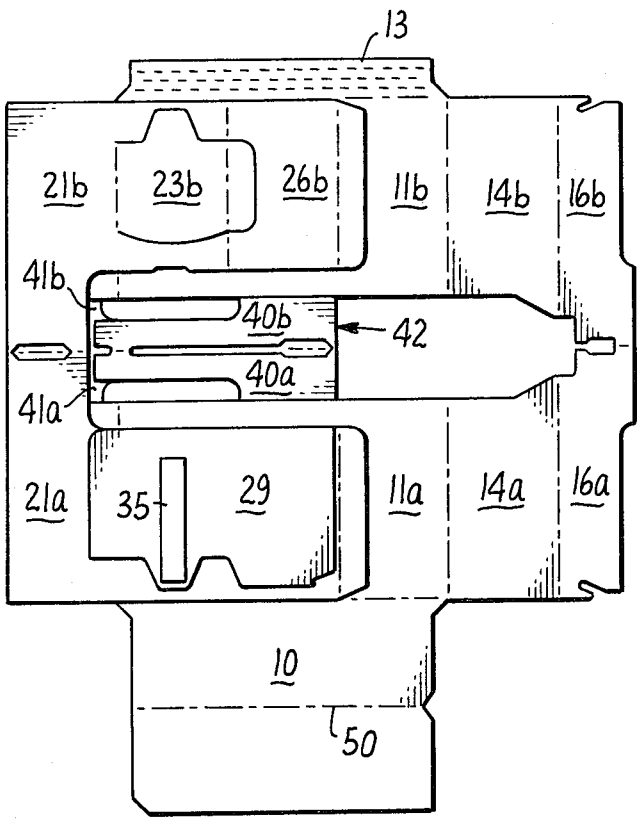
FIG. 9 is a plan view of the folded blank of FIG. 8 showing the third step for partially folding the handle of the carrier carton.

Next the medial reinforcing panel 29 with its carried separator strip 35 folds upon fold line 30 into the position shown in FIG. 8 overlying panels 21*a*, 23*a* and 26*a*. The inner portion 40*a*,40*b* of handle 5 folds upon outer portion 41*a*,41*b* of the handle about a central fold line 42 as shown in FIG. 9. Portions 40*a*,41*a* and 40*b*, 41*b* may be, but need not be, glued together in this folding step.

Figure 10:
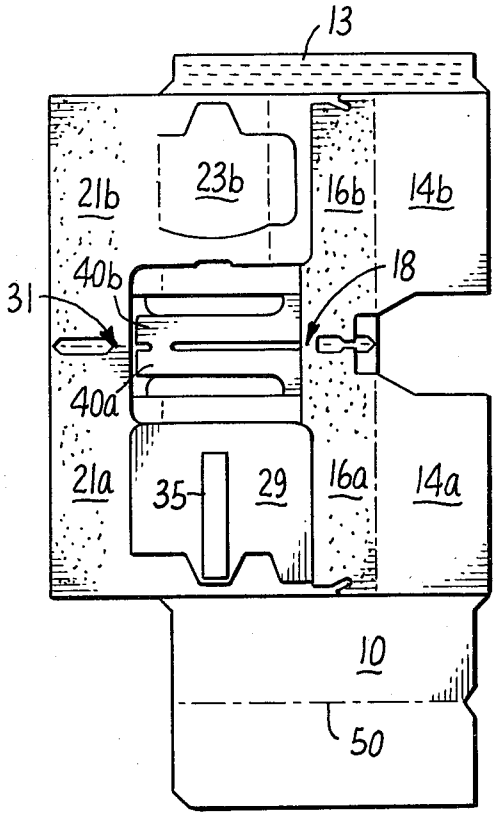
FIG. 10 is a plan view of the folded blank of FIG. 9 showing a fourth fold step for one pair of medial risers and of end-forming panels of the carrier carton.

Then in the step illustrated in FIG. 10 the end-forming panels 14*a*,14*b* and connected first pair of medial risers 16*a*,16*b* fold into the position illustrated so that the medial risers overlie the internal separator panels 26*a*,26*b* that had earlier been glued to the end panels 11*a*,11*b* and medial riser 16*a* also partially overlies medial reinforcing panel 29 immediately below it.

The "b" side of the carton then is folded on the medial axis along fold lines 18 and 31, which join the pairs of the medial risers, and along fold lines 43 and 44 of the partially folded handle that are shown in FIG. 3. Each pair of medial risers may be glued together during this folding step by previous application of adhesive material to the stippled areas in FIG. 10. However, gluing is not essential.

Figure 11:
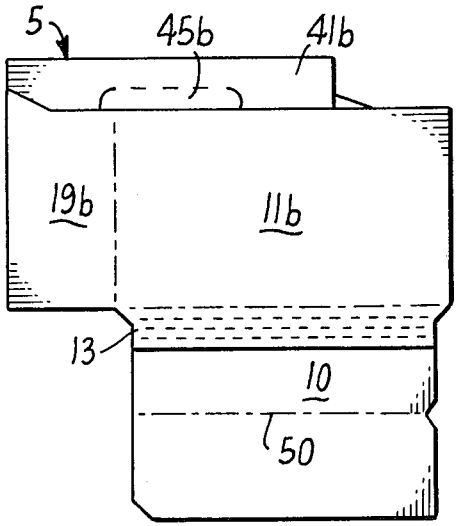
FIG. 11 is a plan view of the partially folded carton of FIG. 10 showing the fold and glue step assembling together each pair of medial risers of the carrier carton.
Figure 12:
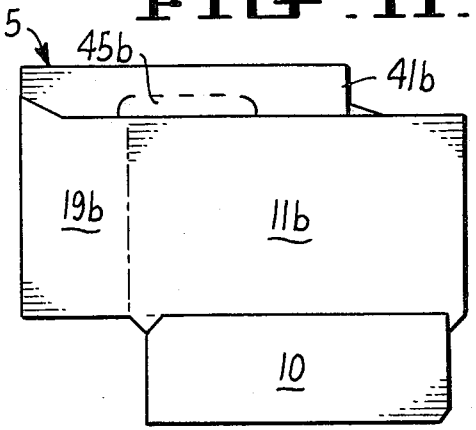
FIG. 12 is a plan view of the folded blank of FIG. 11 showing the final fold and glue step to form the bottom of the carrier carton into its completed, but collapsed, condition.

Then in a final step the bottom panel 10 folds about its central fold line 50 and is adhered along its free margin to tab 13 of side panel 11*b* to which glue has been earlier applied as shown by stippling in FIG. 11. The carton is then complete and in collapsed form as shown in FIG. 12.

Figure 1:
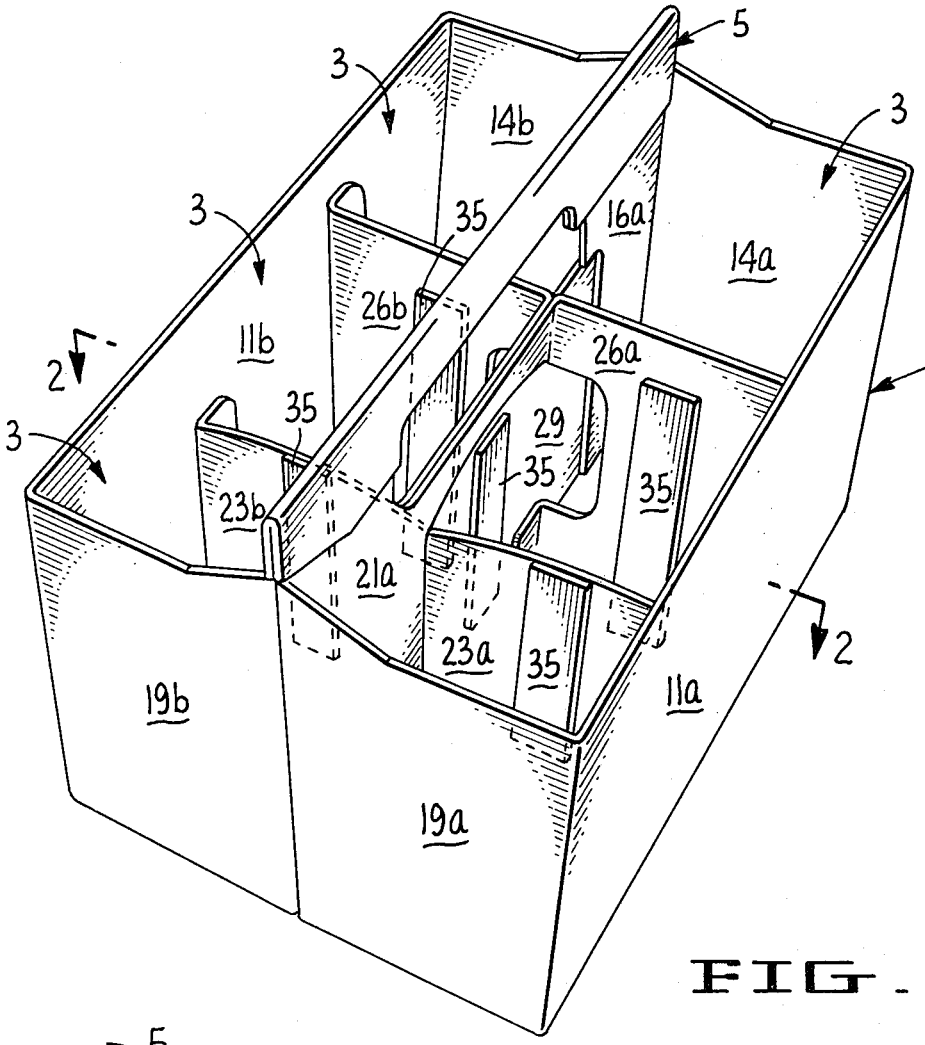
FIG. 1 is a perspective view of the completed carrier carton of this invention.
Figure 5:
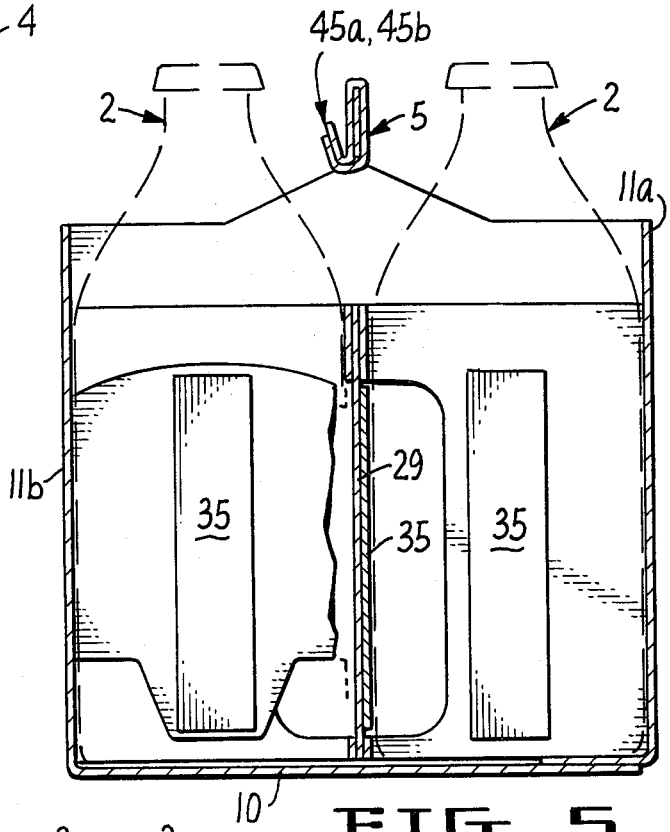
FIG. 5 is a vertical sectional view of the carton and carried bottles along line 5—5 of FIG. 2 illustrating the separator strips on internal separator panels to provide double thickness separation of bottles within the carrier carton.
Figure 6:
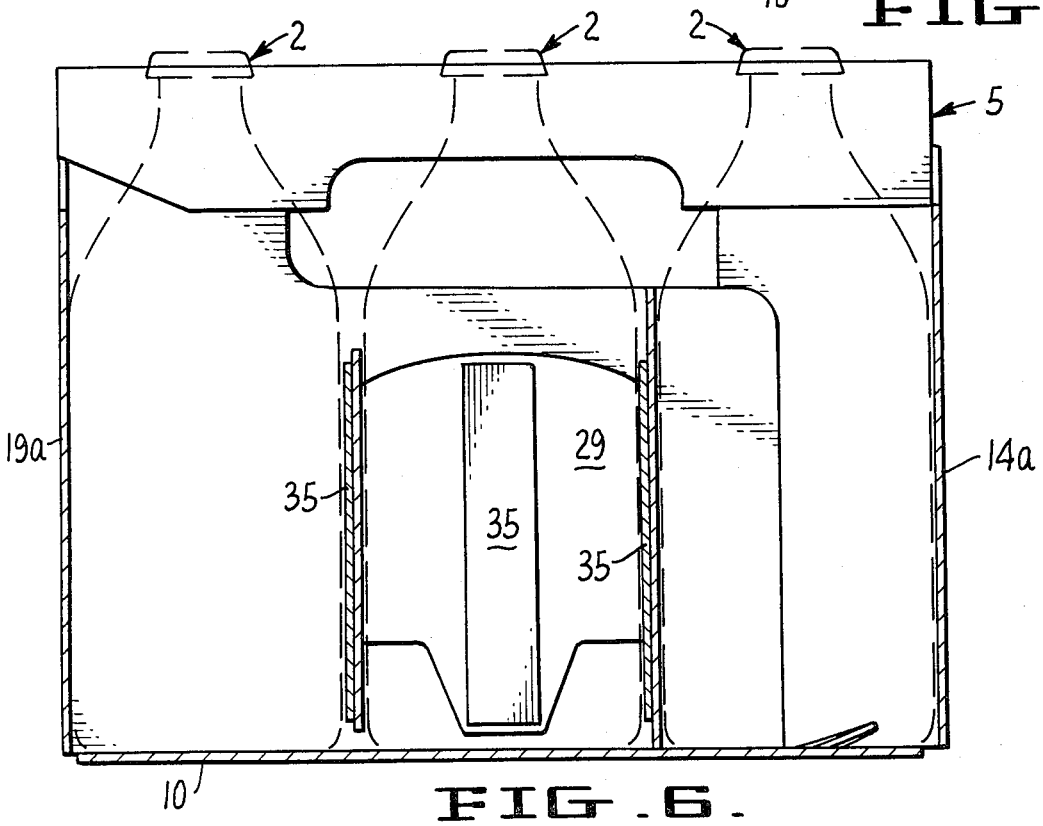
FIG. 6 is a vertical sectional view of the carton and carried bottles along line 6—6 of FIG. 2 illustrating the separator strips surrounding the middle bottle of the dual rows of three bottles.

The carton is expanded into the shape illustrated in FIG. 1 simply by pushing in the end walls. The handle formation is completed by bending upwardly handle tabs 45*a*,45*b* as shown in FIG. 5 to form a four-ply handle with the finger protecting tabs.

The foregoing description is for illustrative purposes only. Various modifications of the preferred embodiment may be apparent and are within the scope of the invention which is defined in the following claims.

I claim:

1. A basket type multi-use carrier carton comprising:

a bottom panel;

a first sidewall panel foldably joined to the bottom panel along a bottom-side panel fold line;

a second sidewall having a foldable tab for securing to it a free margin of the bottom panel opposite said bottom-side panel fold line;

a first pair of end-forming panels each foldably joined to a separate one of the side panels along fold lines perpendicular to said bottom-side panel fold line;

a first pair of medial risers each foldably joined to one of said first pair of end-forming panels along fold lines perpendicular to said bottom-side panel fold line and foldably joined together on the medial axis of the carrier carton;

a second pair of end-forming panels each foldably joined to a separate one of the side panels remote from the first pair of end-forming panels along a fold line also perpendicular to the bottom-side panel fold line;

a second pair of medial risers each foldably joined to one of said second pair of end-forming panels along fold lines also perpendicular to said bottom panel fold line and foldably joined together on the medial axis of the carrier carton;

one internal separator panel struck out from each of the second pair of medial risers and foldable therefrom to be adhered by a tab perpendicular to one of the side panels;

another internal separator panel foldable from each of the second pair of riser panels along fold lines adjacent to the said one internal panel struck out from each riser to be adhered by a tab perpendicular to one of said side walls spaced from said corresponding one internal separator panel to form an article well there between;

a medial reinforcing panel foldably joined to one of the second pair of medial risers along a fold line substantially co-extensive with said one internal separator panel struck from said riser and parallel to said bottom-side panel fold line;

separator strips adhered to each of said internal separator panels and said medial reinforcing panel to provide double material thickness between all carried articles;

each pair of risers being folded on the fold line that joins them and being glued together to form the pair of end-forming panels joined to each of them into a complete end for the carrier carton; and a handle disposed on the medial axis of the carrier above the medial reinforcing panel foldably joined to one pair of medial risers at one end and fixed at its other end to the other pair of medial risers.

2. The article carrier carton of claim 1 wherein said first pair of medial risers adheres between them one end of the medial reinforcing panel.

3. The article carrier carton of claim 1 wherein the bottom panel has a central fold line parallel to said bottom-side panel fold line to enable the assembled carrier to collapse flat.

* * * * *